US011552433B2

(12) United States Patent
Kuo et al.

(10) Patent No.: US 11,552,433 B2
(45) Date of Patent: Jan. 10, 2023

(54) ELECTRICAL CONNECTOR CAPABLE OF ELIMINATING NOISE

(71) Applicant: ACES ELECTRONICS CO., LTD., Taoyuan (TW)

(72) Inventors: Rong-Hsun Kuo, Taoyuan (TW); Chang-Ho Teng, Taoyuan (TW); Chia-Sheng Liang, Taoyuan (TW)

(73) Assignee: ACES ELECTRONICS CO., LTD., Taoyuan (TW)

( * ) Notice: Subject to any disclaimer, the term of this patent is extended or adjusted under 35 U.S.C. 154(b) by 38 days.

(21) Appl. No.: 17/191,235

(22) Filed: Mar. 3, 2021

(65) Prior Publication Data

US 2022/0037838 A1 Feb. 3, 2022

(30) Foreign Application Priority Data

Jul. 31, 2020 (TW) ..... 109209926

(51) Int. Cl.
*H01R 13/6597* (2011.01)
*H01R 24/60* (2011.01)
*H01R 107/00* (2006.01)

(52) U.S. Cl.
CPC ..... *H01R 13/6597* (2013.01); *H01R 24/60* (2013.01); *H01R 2107/00* (2013.01)

(58) Field of Classification Search
None
See application file for complete search history.

(56) References Cited

U.S. PATENT DOCUMENTS

| | | | | |
|---|---|---|---|---|
| 9,525,244 | B1 * | 12/2016 | Hsu | H01R 24/60 |
| 9,531,129 | B2 * | 12/2016 | de Boer | H01R 13/6471 |
| 9,640,915 | B2 * | 5/2017 | Phillips | H01R 13/6585 |
| 10,283,910 | B1 * | 5/2019 | Chen | H01R 13/6461 |
| 10,644,455 | B1 * | 5/2020 | Champion | H01R 13/6464 |
| 11,289,856 | B1 * | 3/2022 | Teng | H01R 13/6581 |
| 2013/0288513 | A1 * | 10/2013 | Masubuchi | H01R 31/08 439/386 |
| 2015/0255904 | A1 * | 9/2015 | Ito | H01R 12/721 439/88 |

* cited by examiner

*Primary Examiner* — Oscar C Jimenez
(74) *Attorney, Agent, or Firm* — Muncy, Geissler, Olds & Lowe, P.C.

(57) ABSTRACT

An electrical connector is disclosed. The electrical connector has a casing, a terminal seat and a conductive plastic element. The terminal seat is mounted in the casing and has an insulator board and a terminal set. The terminal set has a ground terminal and a high-speed signal terminal set. One side of the conductive plastic element is mounted on an inner wall of the casing and another side thereof passes through the insulator board to be close to the high-speed signal terminal set. When the casing is electrically connected to a ground, the conductive plastic element is electrically connected to the ground through the casing. Therefore, the conductive plastic element may eliminate a noise interference caused by the high-speed signal terminal set during high-speed transmission. A crosstalk and a common-mode interference are also reduced to keep the stability of signal transmission of the electrical connector.

20 Claims, 16 Drawing Sheets

ELECTRICAL CONNECTOR CAPABLE OF ELIMINATING NOISE

CROSS-REFERENCE TO RELATED APPLICATIONS

This application is based upon and claims priority under 35 U.S.C. 119 from Taiwan Patent Application No. 109209926 filed on Jul. 31, 2020, which is hereby specifically incorporated herein by this reference thereto.

BACKGROUND OF THE INVENTION

1. Field of the Invention

The present invention is related to an electrical connector, and more particularly to an electrical connector capable of eliminating noise.

2. Description of the Prior Arts

Since a USB connector has a hot-plug function and plug-and-play function, the USB connectors are widely used in various consumer electronic devices, such as personal computers, digital cameras, smart phones, and wearable electrical devices. USB-IF provides USB 3.1 adding a new transfer rate to transmit more data and be compatible with previous visions of USB standards.

The USB 3.1 connector has 9 terminals mounted on an insulator board. The gap between adjacent terminals is very small, so a serious crosstalk issue occurs during high-speed transmission. Furthermore, a distance between the power terminal and the ground terminal is too far to be coupled to each other, so the power terminal is coupled with the adjacent terminals, such as the high-frequency differential terminals or the low-frequency differential terminals. Common-mode interference is accordingly occurred to reduce the stability of the signal transmission.

To overcome the shortcomings, the present invention provides an electrical connector to mitigate or to obviate the aforementioned problems.

SUMMARY OF THE INVENTION

The objective of the present invention is to provide an electrical connector.

To achieve the objective as mentioned above, the electrical connector has:

a casing having an inner wall;

a terminal seat mounted in the casing and having:

an insulator board;

a terminal set mounted on the insulator board and having at least one ground terminal and a high-speed signal terminal set; and a first conductive plastic element having:

a first side mounted on the inner wall of the casing; and a second side passing through the insulator board and being close to the high-speed signal terminal set.

With the foregoing description, in the electrical connector of the present invention, the first conductive plastic element is used to touch the casing and being close to the high-speed signal terminal set. When the casing is electrically connected to ground, the first conductive plastic element is also electrically connected to the ground through the casing. Therefore, the first conductive plastic element eliminates a noise interference caused by the high-speed signal terminal to reduce the crosstalk and the common-mode interference and keeps the stability of signal transmission of the electrical connector.

Other objectives, advantages and novel features of the invention will become more apparent from the following detailed description when taken in conjunction with the accompanying drawings.

DETAILED DESCRIPTION OF THE EMBODIMENTS

With multiple embodiments and drawings thereof, the features of the present invention are described in detail as follows.

Figure 1:
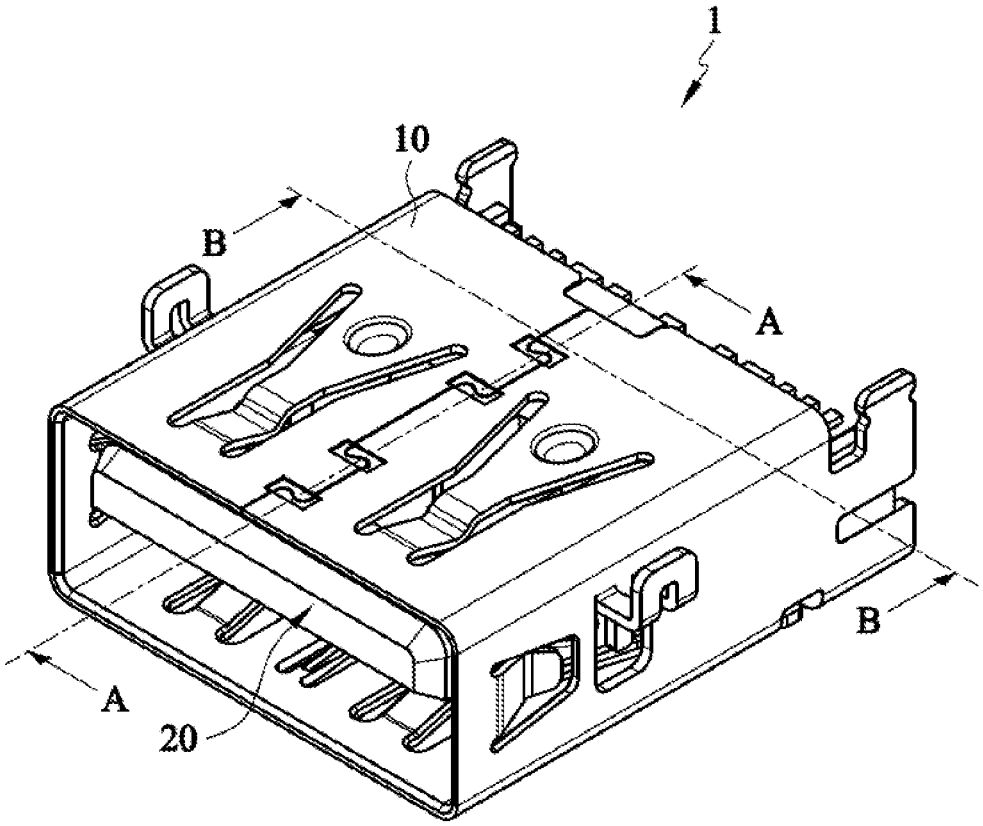
FIG. 1 is a perspective view of an electrical connector in accordance with the present invention.
Figure 2A:
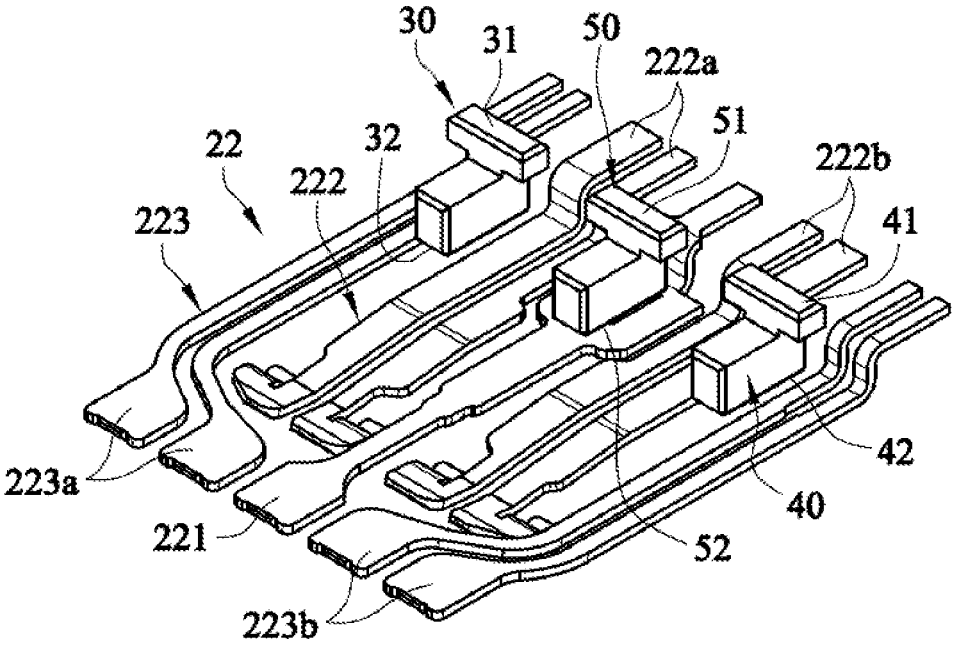
FIG. 2A is a perspective view of a first embodiment of a combination of terminals and conductive plastic element in accordance with the present invention.

With reference to FIGS. 1 and 2A, a first embodiment of an electrical connector 1 of the present invention has a casing 10, a terminal seat 20 and at least one conductive plastic element. In one embodiment, the electrical connector 1 has a first conductive plastic element 30, a second conductive plastic element 40 and a third conductive plastic element 50, but not limited to.

The casing 10 is made of metal. The casing may be electrically connected to the ground when the electrical connector is used.

The terminal seat 20 is mounted in the casing 10 and has an insulator board 21 and a terminal set 22. The terminal set 22 has at least one ground terminal 221 and a high-speed signal terminal set 223. The ground terminal 221 and the high-speed signal terminal set 223 are parallelly mounted on the insulator board 21. The high-speed signal terminal set 223 has a pair of first high-speed signal terminals 223*a* (SSTX+, SSTX−) and a pair of second high-speed signal terminals 223*b* (SSRX+, SSRX−) respectively located two opposite sides of the ground terminal 221. That is, the ground terminal 221 is located between the pairs of first high-speed signal terminals 223*a* (SSTX+, SSTX−) and the pair of second high-speed signal terminals 223*b* (SSRX+, SSRX−). Using a USB 3.1 connector as an example, the terminal seat 20 further has a low-speed signal terminal set 222. The low-speed signal terminal set 222 has a pair of first low-speed signal terminals 222*a* (VBUS, D−) and a pair of second low-speed signal terminals 222*b* (GND, D+). The ground terminal 221 is located between the pair of first low-speed signal terminals 222*a* (VBUS, D−) and the pair of second low-speed signal terminals 222*b* (GND, D+). The pairs of first low-speed signal terminals 222*a* (VBUS, D−) are located between the ground terminal 221 and the pairs of first high-speed signal terminals 223*a* (SSTX+, SSTX−). The pairs of second low-speed signal terminals 222*a* (GND, D+) are located between the ground terminal 221 and the pair of second high-speed signal terminals 223*b* (SSRX+, SSRX−).

Figure 7A:
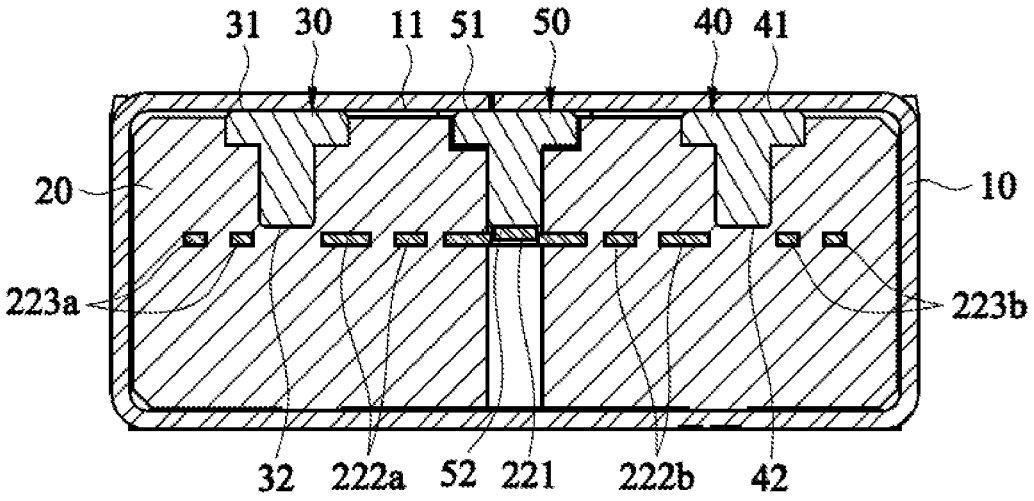
FIG. 7A is a cross-sectional view taken along A-A line of FIG. 1.
Figure 7B:
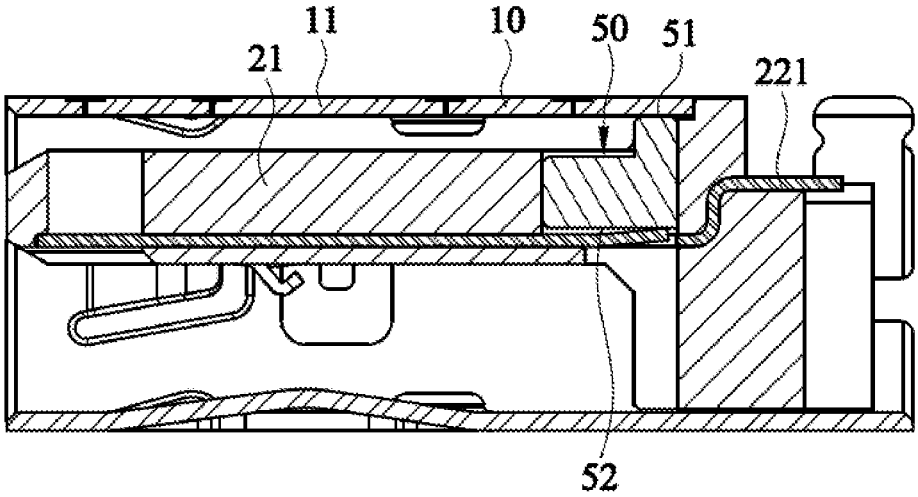
FIG. 7B is another cross-sectional view taken along B-B line of FIG. 1.

With reference to FIGS. 2A and 7A, the first conductive plastic element 30 and the second conductive plastic element 40 are mounted between an inner wall 11 of the casing 10 and outsides of the high-speed signal terminal set 223. In one embodiment, the first conductive plastic element 30 has a first side 31 and second side 32. The first side 31 is mounted on the inner wall 11 and the second side 32 passes through the insulator board 21 and corresponds to the outside of the pair of first high-speed signal terminals 223*a*. In one embodiment, the second side 32 of the first conductive plastic element 30 is located between the pair of first high-speed signal terminals 223*a* and the pair of first low-speed signal terminal 222*a*. In addition, a third side 41 of the second conductive plastic element 40 is mounted the inner wall 11 of the casing 10 and a fourth side 42 of the second conductive plastic element 40 passes through the insulator board 21 to correspond to the outside of the pair of second high-speed signal terminals 223*b*. In one embodiment, the fourth side 42 of the second conductive plastic element 40 is located between the pair of second high-speed signal terminals 223*b* and the pair of second low-speed signal terminal 222*b*. In one embodiment, as shown in FIG. 7B, a fifth side 51 of the third conductive plastic element 50 the inner wall 11 of the casing 10 and a sixth side 52 of the third conductive plastic element 50 passes through the insulator board 21 to contact with the ground terminal 221.

Figure 2B:
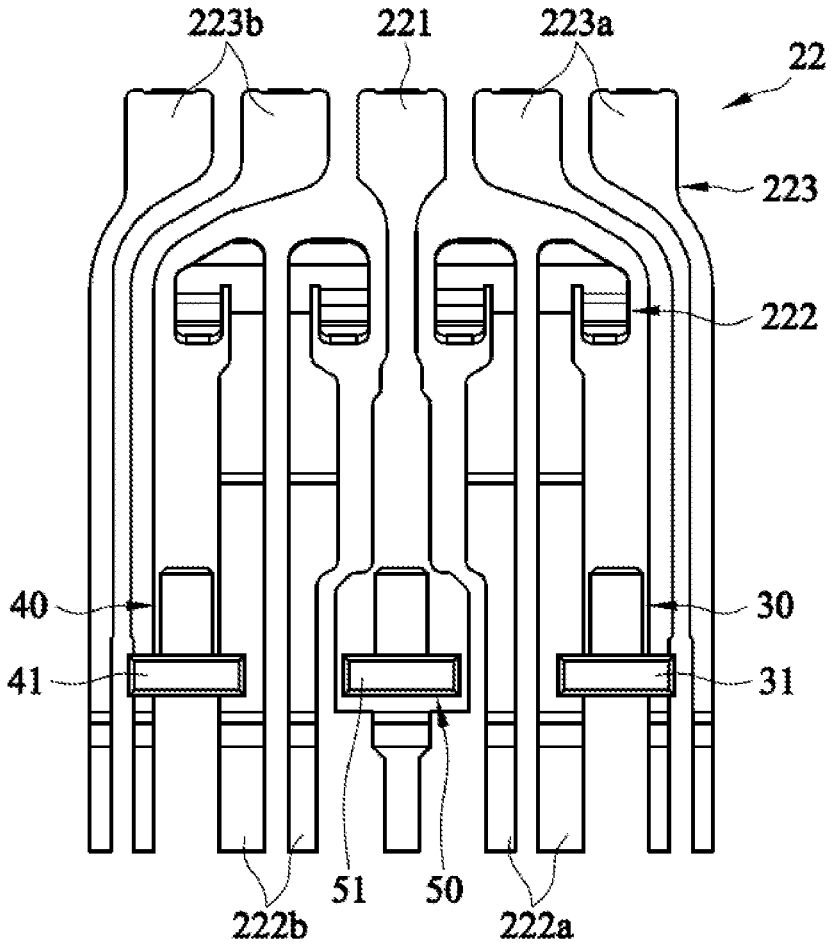
FIG. 2B is a top plan view of FIG. 2A.

With reference to FIG. 2B, in one embodiment, since the second, fourth and sixth sides 32, 42, 52 are parallel with the terminal set 22 and the first, third and fifth sides 31, 41, 51 are orthogonal with the terminal set 22, each of the first, second and third conductive plastic elements is shaped of "T". The first side 31 is located above the pair of first high-speed signal terminals 223*a* and the pair of first low-speed signal terminals 222*a*. The third side 41 is located above the pair of second high-speed signal terminals 223*b* and the pair of second low-speed signal terminals 222*b*. The fifth side 51 is located above the ground terminal 221. In one embodiment, the first and second conductive plastic elements 30, 40 are electrically connected to the ground through the casing 10, so the first and second conductive plastic elements 30, 40 eliminate the noise interference caused by the pairs of the first and second high-speed signal terminals 223*a*, 223*b*. A grounding effect of the ground terminal 224 is increased through the third conductive plastic element 50 and the casing 10. Therefore, the electrical connector of the present invention keeps the stability of the signal transmission.

Figure 3A:
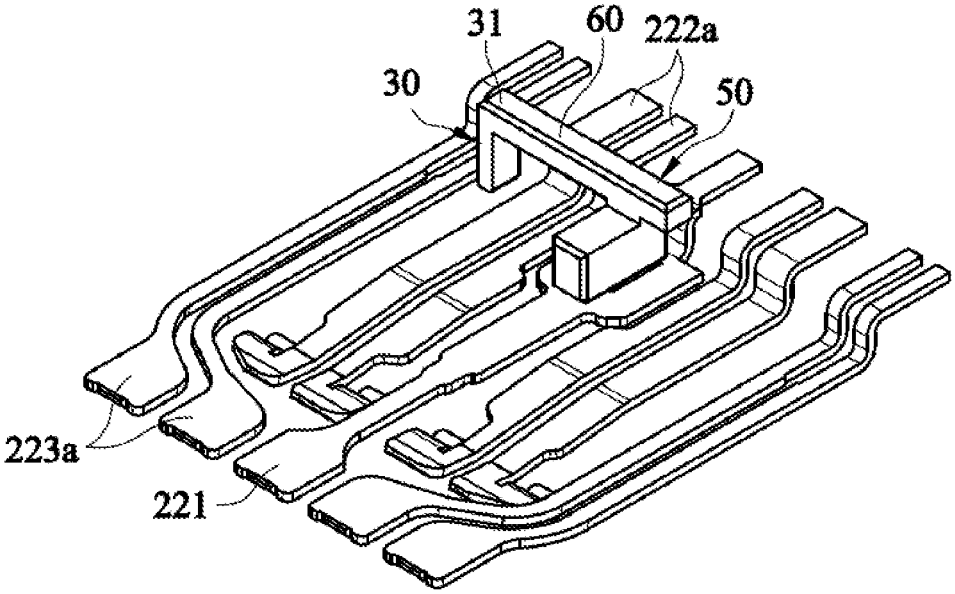
FIG. 3A is a perspective view of a combination of terminals and conductive plastic elements of a second embodiment of an electrical connector in accordance with the present invention.

With reference to FIG. 3A, a combination of terminals and at least one conductive plastic element of a second embodiment of an electrical connector of the present invention is similar to that of the first embodiment of FIG. 2A. The difference is that the second embodiment of the electrical connector does not have the second conductor plastic element 40 of the first embodiment, but further has a fourth conductive plastic element 60. In the second embodiment, the first conductor plastic element 30 is connected to the third conductor plastic element 50 through the fourth conductor plastic element 60. The fourth conductor plastic element 60 is mounted on the inner wall of the casing.

Figure 3B:
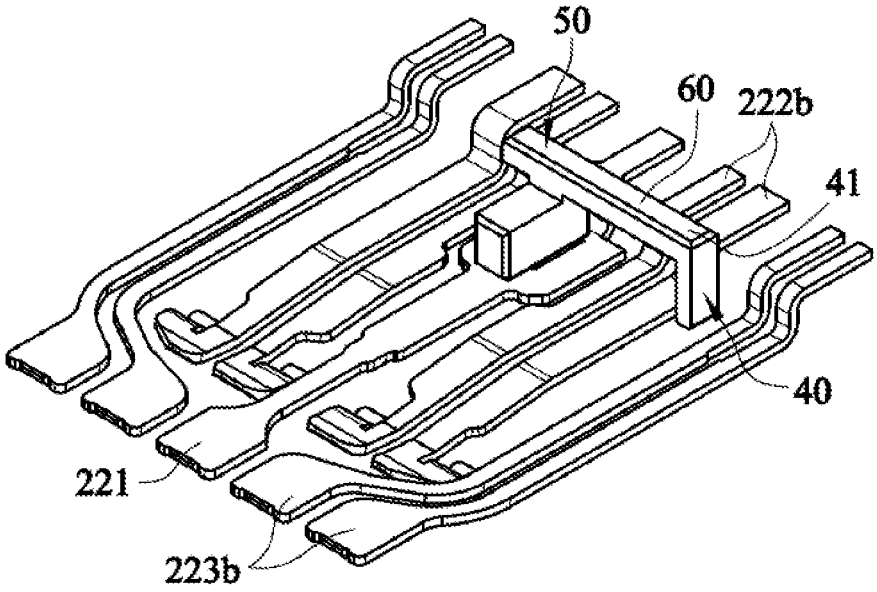
FIG. 3B is a perspective view of a combination of terminals and conductive plastic elements of a third embodiment of an electrical connector in accordance with the present invention.

With reference to FIG. 3B, a combination of terminals and at least one conductive plastic element of a third embodiment of an electrical connector of the present invention is similar to that of the first embodiment of FIG. 2A. The difference is that the third embodiment of the electrical connector does not have the first conductor plastic element 30 of the first embodiment, but further has a fourth conductive plastic element 60. In the third embodiment, the second conductor plastic element 40 is connected to the third conductor plastic element 50 through the fourth conductor plastic element 60. The fourth conductor plastic element 60 is mounted on the inner wall of the casing.

Figure 3C:
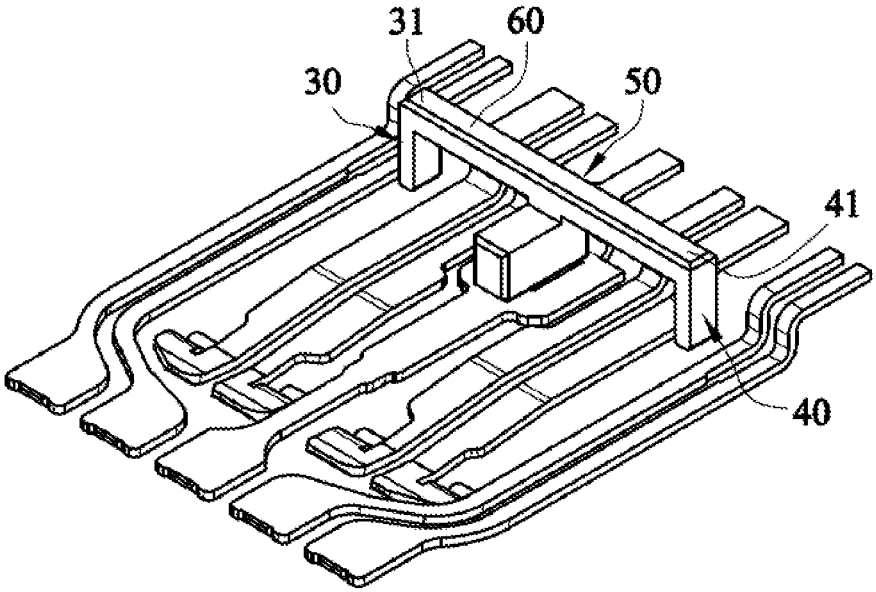
FIG. 3C is a perspective view of a combination of terminals and conductive plastic elements of a fourth embodiment of an electrical connector in accordance with the present invention.
Figure 3D:
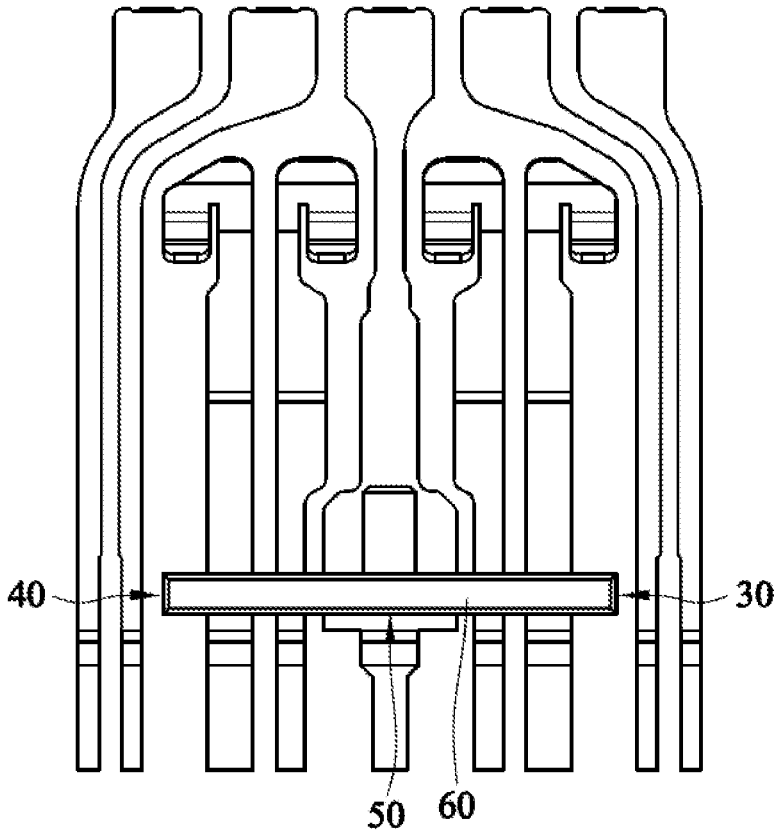
FIG. 3D is a top plan view of FIG. 3C.

With reference to FIGS. 3C and 3D, a combination of terminals and at least one conductive plastic element of a fourth embodiment of an electrical connector of the present invention is similar to that of the first embodiment of FIG. 2A. The difference is that the fourth embodiment further has a fourth conductive plastic element 60. The fourth conductive plastic element 60 is connected to the first, second and third conductive plastic elements 30, 40, 50 and is mounted on the inner wall of the casing.

Figure 4A:
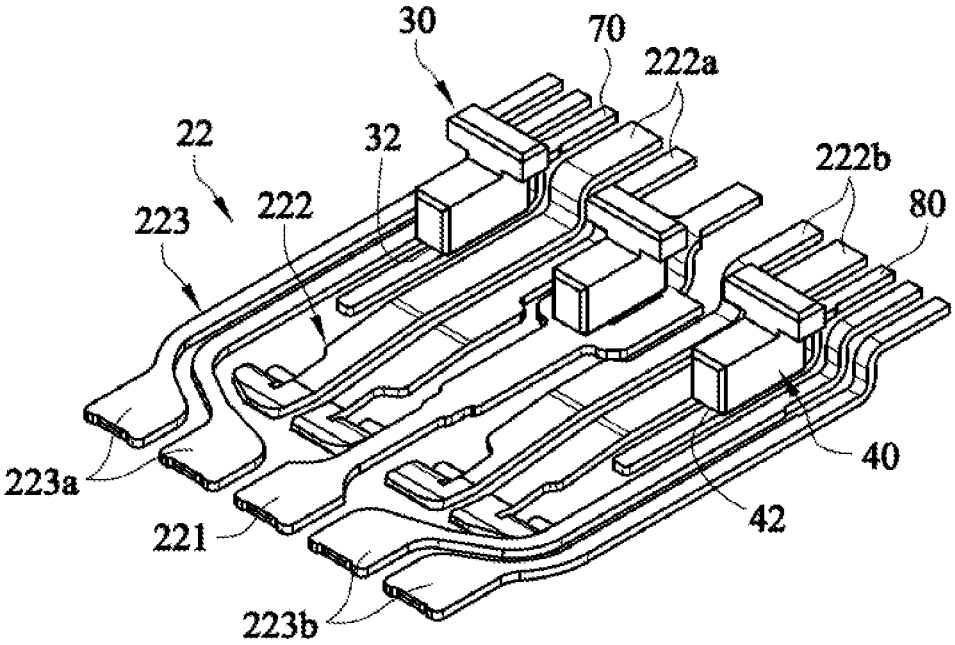
FIG. 4A is a perspective view of a combination of terminals and conductive plastic elements of a fifth embodiment of an electrical connector in accordance with the present invention.
Figure 4B:
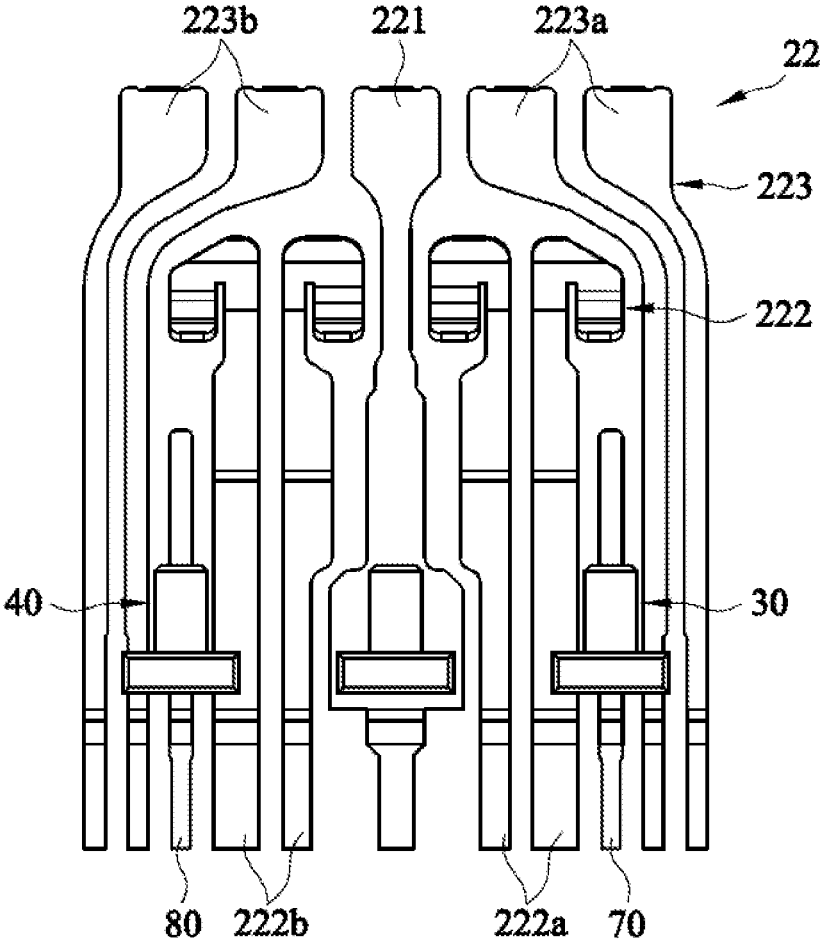
FIG. 4B is a top plan view of FIG. 4A.

With reference to FIGS. 4A and 4B, to increase a stability of high-speed transmission of the electrical connector, in a fifth embodiment, an electrical connector further has a first signal shielding terminal 70. The first signal shielding terminal 70 is also mounted on the insulator board and located the outside of the pair of first high-speed signal terminals 223*a*. In the fifth embodiment, the first signal shielding terminal 70 is located between the pair of first high-speed signal terminals 223*a* and the pair of first low-speed signal terminals 222*a*, and contacts with the second side 32 of the first conductive plastic element 30. The electrical connector may further have a second signal shielding terminal 80. The second signal shielding terminal 80 is also mounted on the insulator board and located outside the pair of second high-speed signal terminals 223*b*. In the fifth embodiment, the second signal shielding terminal 80 is located between the pair of second high-speed signal terminals 223*b* and the pair of second low-speed signal terminals 222*b*, and contacts with the fourth side 42 of the second conductive plastic element 40.

Figure 5A:
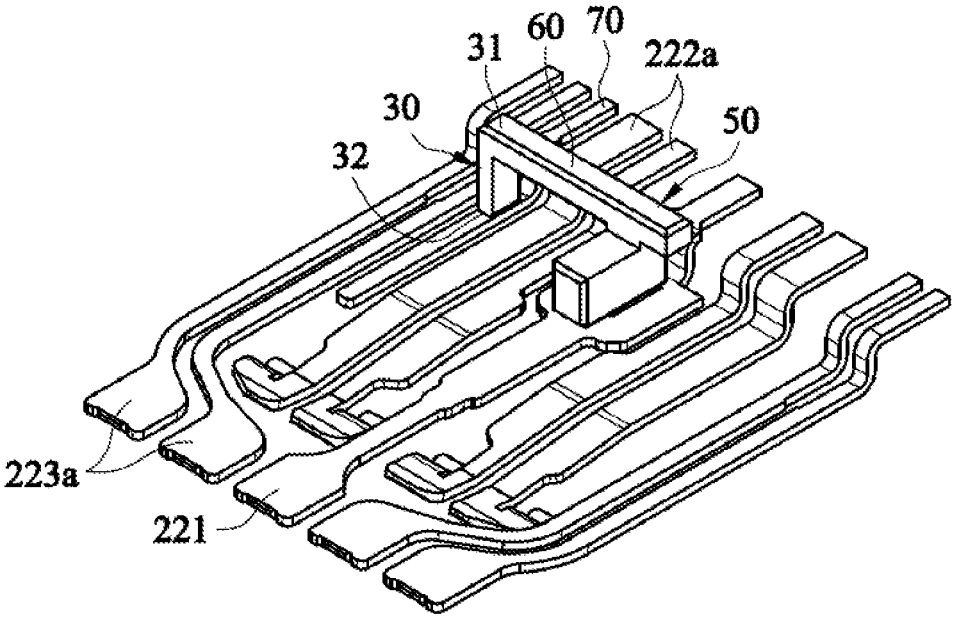
FIG. 5A is a perspective view of a combination of terminals and conductive plastic elements of a sixth embodiment of an electrical connector in accordance with the present invention.
Figure 5B:
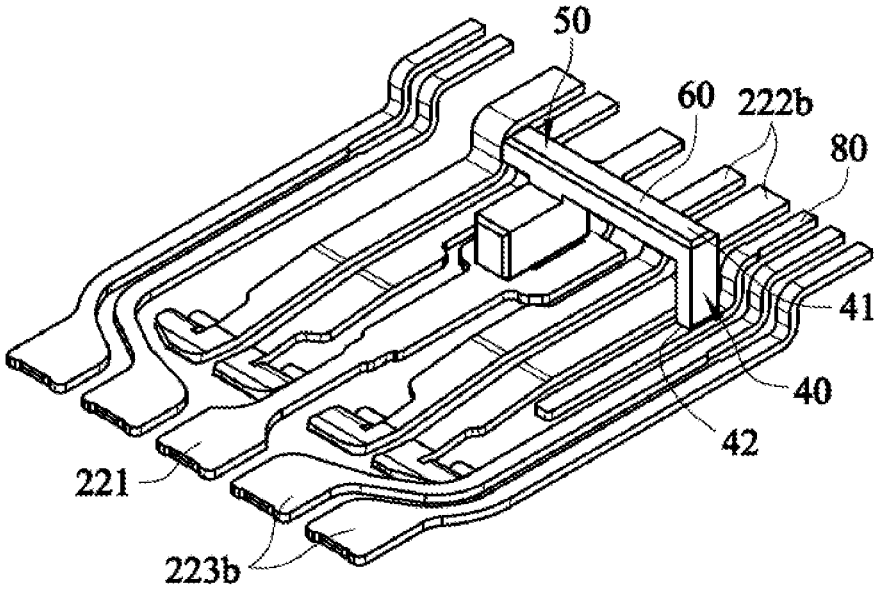
FIG. 5B is a perspective view of a combination of terminals and conductive plastic elements of a seventh embodiment of an electrical connector in accordance with the present invention.

With reference to FIG. 5A, a combination of terminals and at least one conductive plastic element of a sixth embodiment of an electrical connector of the present invention is similar to that of the second embodiment of FIG. 3A. The difference is that the sixth embodiment of the electrical connector further has a first signal shielding terminal 70 located between the pair of first high-speed signal terminals 223*a* and the pair of first low-speed signal terminals 222*a* and contacted with the second side 32 of the first conductive plastic element 30. With reference to FIG. 5B, a combination of terminals and at least one conductive plastic element of a seventh embodiment of an electrical connector of the present invention is similar to that of the third embodiment of FIG. 3B. The difference is that the seventh embodiment of the electrical connector further has a second signal shielding terminal 80 located between the pair of first low-speed signal terminals 223*b* and the pair of second low-speed signal terminals 222*b* and contacted with the fourth side 42 of the second conductive plastic element 40.

Figure 5C:
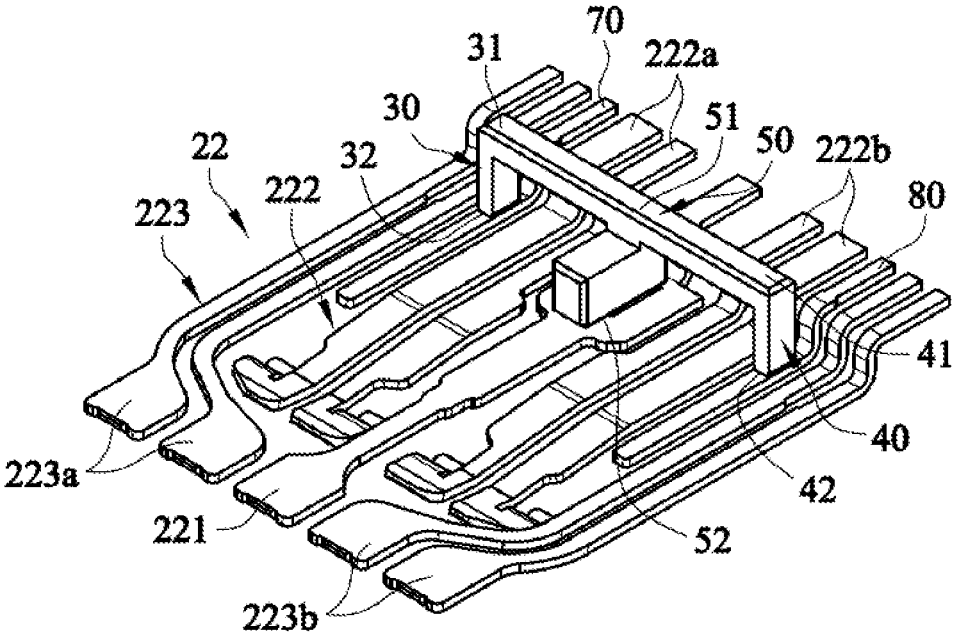
FIG. 5C is a perspective view of a combination of terminals and conductive plastic elements of an eighth embodiment of an electrical connector in accordance with the present invention.
Figure 5D:
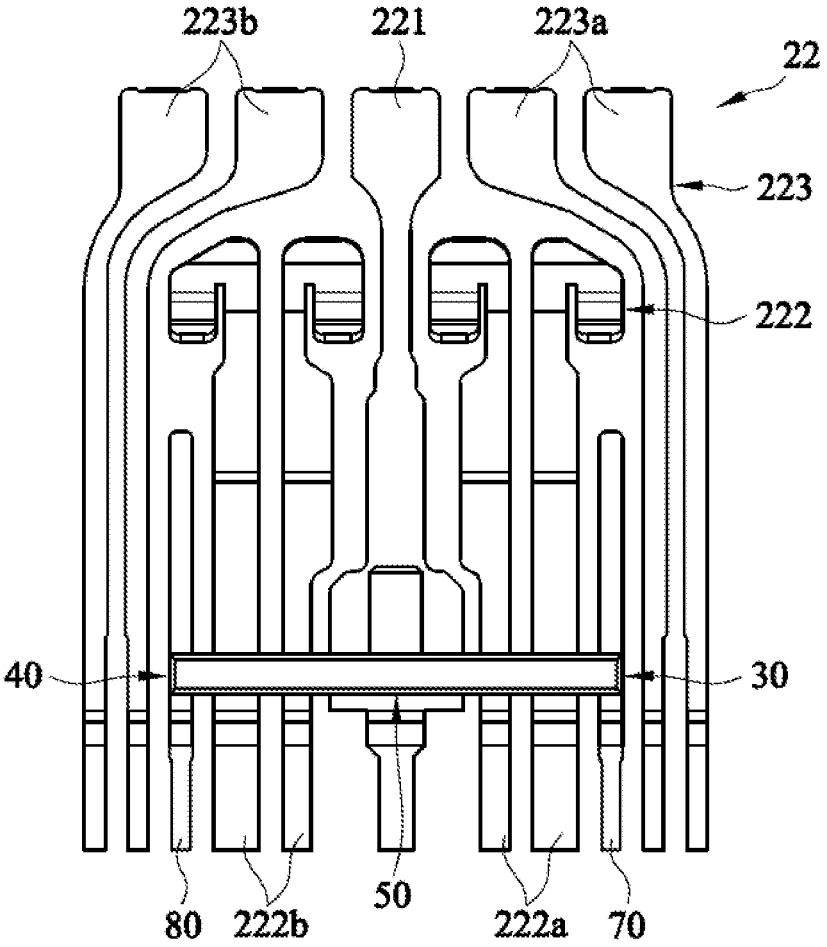
FIG. 5D is a top plan view of FIG. 5C.
Figure 6:
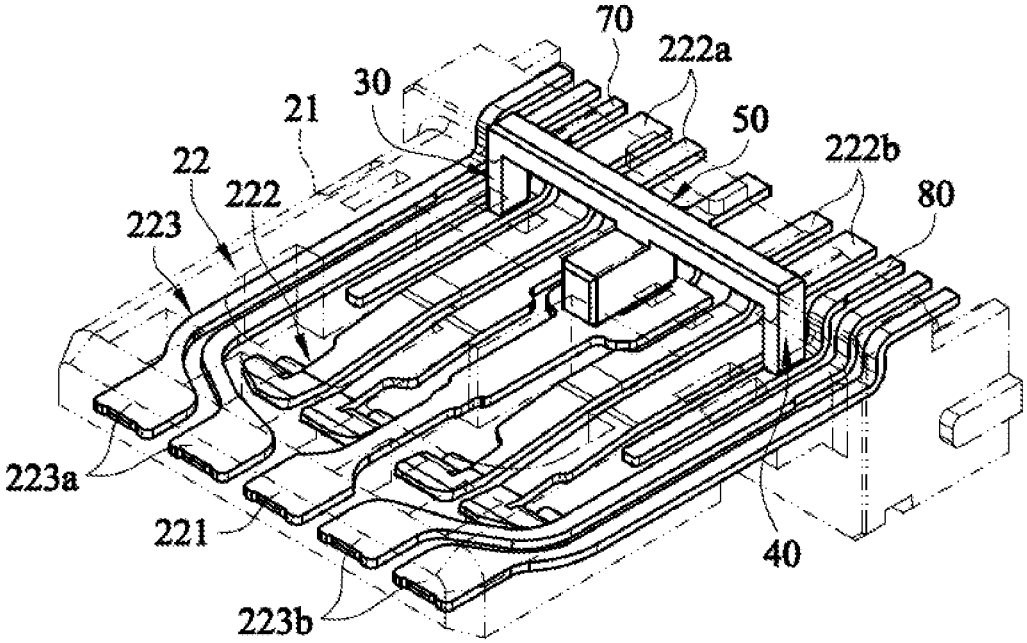
FIG. 6 is a perspective view of another electrical connector in accordance with the present invention.

With reference to FIGS. 5C, 5D and 6, a combination of terminals and at least one conductive plastic element of an eighth embodiment of an electrical connector of the present invention is similar to that of the fourth embodiment of FIGS. 3C and 3D. The difference is that the eighth embodiment of the electrical connector further has a first signal shielding terminal 70 and a second signal shielding terminal 80. The first signal shielding terminal 70 is located between the pair of first high-speed signal terminals 223*a* and the pair of first low-speed signal terminals 222*a*, and contacts with the second side 32 of the first conductive plastic element 30. The electrical connector may further have a second signal shielding terminal 80. The second signal shielding terminal 80 is located between the pair of second high-speed signal terminals 223*b* and the pair of second low-speed signal terminals 222*b*, and contacts with the fourth side 42 of the second conductive plastic element 40.

Based on the foregoing description, the electrical connector of the present invention has the first conductive plastic element mounted in the casing. One side of the first conductive plastic element contacts with the inner wall of the casing and another side thereof passes through the insulator board to be close to one of the first high-speed signal terminals. When the casing is electrically connected to the ground, the first conductor plastic element is also electrically connected to the ground through the casing. Therefore, the first conductor plastic element may eliminate the noise interference caused by the high-speed signal terminals during high-speed transmission. The crosstalk and the common-mode interference are also reduced to keep the stability of signal transmission of the electrical connector. Furthermore, the electrical connector of the present invention has a second conductive plastic element. Since the second conductive plastic element contacts with the inner wall of the casing and is close to one of the second high-speed signal terminals, the second conductor plastic element may eliminate the noise interference caused by the high-speed signal terminals during high-speed transmission. To increase the grounding effect, the third conductive plastic element is mounted in the casing, one side thereof contacts with the inner wall of the casing and another side thereof contacts with the ground terminal. When the casing is electrically connected to the ground, the grounding effect of the ground terminal is increased through the third conductive plastic element and the casing. In addition, the first, second and third conductive plastic elements are integrated formed by the fourth conductive plastic element to increase the grounding effect.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An electrical connector, comprising:
- a casing having an inner wall;
- a terminal seat mounted in the casing and having:
  - an insulator board;
  - a terminal set mounted on the insulator board and having at least one ground terminal and a high-speed signal terminal set; and
- a first conductive plastic element having:
  - a first side mounted on the inner wall of the casing; and
  - a second side passing through the insulator board and located between the at least one ground terminal set and the high-speed signal terminal set, but not contacted with the at least one ground terminal set and the high-speed signal terminal set.

2. The electrical connector as claimed in claim 1, wherein the high-speed signal set has a pair of first high-speed signal terminals and a pair of second high-speed signal terminals, wherein the second side of the first conductive plastic element is located on an outside of the pair of first high-speed signal terminals.

3. The electrical connector as claimed in claim 2, further comprising a second conductive plastic element, wherein the second conductive plastic element has:
- a third side mounted on the inner wall of the casing; and
- a fourth side passing through the insulator board to be close to an outside of the pair of second high-speed signal terminal.

4. The electrical connector as claimed in claim 3, further comprising a third conductive plastic element, wherein the third conductive plastic element has:
- a fifth side mounted on the inner wall of the casing; and
- a sixth side passing through the insulator board to contact with the at least one ground terminal.

5. The electrical connector as claimed in claim 4, further comprising a fourth conductive plastic element mounted on the inner wall of the casing, wherein the fourth conductive plastic element is connected to the first conductive plastic element, the second conductive plastic element and the third conductive plastic element.

6. The electrical connector as claimed in claim 5, wherein
- the terminal set further has a low-speed signal terminal set and the low-speed signal terminal set has:
- a pair of first low-speed signal terminals mounted on the insulator board and located between the at least one ground terminal and the pair of first high-speed signal terminals; and
- a pair of second low-speed signal terminals mounted on the insulator board and located between the at least one ground terminal and the pair of second high-speed signal terminals;
- the second side of the first conductive plastic element is located between the pair of first high-speed signal terminals and the pair of first low-speed signal terminals; and
- the fourth side of the second conductive plastic element is located between the pair of second high-speed signal terminals and the pair of second low-speed signal terminals.

7. The electrical connector as claimed in claim 4, wherein
- the terminal set further has a low-speed signal terminal set and the low-speed signal terminal set has:

a pair of first low-speed signal terminals mounted on the insulator board and located between the at least one ground terminal and the pair of first high-speed signal terminals; and a pair of second low-speed signal terminals mounted on the insulator board and located between the at least one ground terminal and the pair of second high-speed signal terminals;

the second side of the first conductive plastic element is located between the pair of first high-speed signal terminals and the pair of first low-speed signal terminals; and the fourth side of the second conductive plastic element is located between the pair of second high-speed signal terminals and the pair of second low-speed signal terminals.

8. The electrical connector as claimed in claim 2, further comprising a third conductive plastic element, wherein the third conductive plastic element has:

a fifth side mounted on the inner wall of the casing; and a sixth side passing through the insulator board to contact with the at least one ground terminal.

9. The electrical connector as claimed in claim 2, wherein the terminal set further comprises a first signal shielding terminal mounted on the insulator board and located on the outside of the pair of first high-speed signal terminals, wherein the first signal shielding terminal is contacted with the second side of the first conductive plastic element.

10. The electrical connector as claimed in claim 9, further comprising a second conductive plastic element, wherein the second conductive plastic element has:

a third side mounted on the inner wall of the casing; and a fourth side passing through the insulator board to be close to an outside of the pair of second high-speed signal terminals; and the terminal set further has a second signal shielding terminal mounted on the insulator board and located on the outside of the pair of second high-speed signal terminals, wherein the second signal shielding terminal is contacted with the fourth side of the second conductive plastic element.

11. The electrical connector as claimed in claim 10, further comprising a third conductive plastic element, wherein the third conductive plastic element has:

a fifth side mounted on the inner wall of the casing; and a sixth side passing through the insulator board to contact with the at least one ground terminal.

12. The electrical connector as claimed in claim 11, further comprising a fourth conductive plastic element mounted on the inner wall of the casing, wherein the fourth conductive plastic element is connected to the first conductive plastic element, the second conductive plastic element and the third conductive plastic element.

13. The electrical connector as claimed in claim 12, wherein the terminal set further has a low-speed signal terminal set and the low-speed signal terminal set has:

a pair of first low-speed signal terminals mounted on the insulator board and located between the at least one ground terminal and the pair of first high-speed signal terminals; and a pair of second low-speed signal terminals mounted on the insulator board and located between the at least one ground terminal and the pair of second high-speed signal terminals;

the second side of the first conductive plastic element and the first signal shielding terminal are located between the pair of first high-speed signal terminals and the pair of first low-speed signal terminals; and the fourth side of the second conductive plastic element and the second signal shielding terminal are located between the pair of second high-speed signal terminals and the pair of second low-speed signal terminals.

14. The electrical connector as claimed in claim 11, wherein the terminal set further has a low-speed signal terminal set and the low-speed signal terminal set has:

a pair of first low-speed signal terminals mounted on the insulator board and located between the at least one ground terminal and the pair of first high-speed signal terminals; and a pair of second low-speed signal terminals mounted on the insulator board and located between the at least one ground terminal and the pair of second high-speed signal terminals;

the second side of the first conductive plastic element and the first signal shielding terminal are located between the pair of first high-speed signal terminals and the pair of first low-speed signal terminals; and the fourth side of the second conductive plastic element and the second signal shielding terminal are located between the pair of second high-speed signal terminals and the pair of second low-speed signal terminals.

15. The electrical connector as claimed in claim 10, further comprising a fourth conductive plastic element mounted on the inner wall of the casing, wherein the fourth conductive plastic element is connected between the first conductive plastic element and the third conductive plastic element.

16. The electrical connector as claimed in claim 15, wherein the terminal set further has a low-speed signal terminal set and the low-speed signal terminal set has:

a pair of first low-speed signal terminals mounted on the insulator board and located between the at least one ground terminal and the pair of first high-speed signal terminals; and a pair of second low-speed signal terminals mounted on the insulator board and located between the at least one ground terminal and the pair of second high-speed signal terminals;

the second side of the first conductive plastic element and the first signal shielding terminal are located between the pair of first high-speed signal terminals and the pair of first low-speed signal terminals; and the fourth side of the second conductive plastic element and the second signal shielding terminal are located between the pair of second high-speed signal terminals and the pair of second low-speed signal terminals.

17. The electrical connector as claimed in claim 10, wherein the terminal set further has a low-speed signal terminal set and the low-speed signal terminal set has:

a pair of first low-speed signal terminals mounted on the insulator board and located between the at least one ground terminal and the pair of first high-speed signal terminals; and a pair of second low-speed signal terminals mounted on the insulator board and located between the at least one ground terminal and the pair of second high-speed signal terminals;

the second side of the first conductive plastic element and the first signal shielding terminal are located between the pair of first high-speed signal terminals and the pair of first low-speed signal terminals; and the fourth side of the second conductive plastic element and the second signal shielding terminal are located between the pair of second high-speed signal terminals and the pair of second low-speed signal terminals.

18. The electrical connector as claimed in claim 9, further comprising a third conductive plastic element, wherein the third conductive plastic element has:

a fifth side mounted on the inner wall of the casing; and a sixth side passing through the insulator board to contact with the at least one ground terminal.

19. The electrical connector as claimed in claim 18, wherein the terminal set further has a low-speed signal terminal set and the low-speed signal terminal set has:

a pair of first low-speed signal terminals mounted on the insulator board and located between the at least one ground terminal and the pair of first high-speed signal terminals; and a pair of second low-speed signal terminals mounted on the insulator board and located between the at least one ground terminal and the pair of second high-speed signal terminals; and the second side of the first conductive plastic element and the first signal shielding terminal are located between the pair of first high-speed signal terminals and the pair of first low-speed signal terminals.

20. The electrical connector as claimed in claim 1, wherein the terminal set further has a low-speed signal terminal set.

* * * * *